US006945076B1

(12) United States Patent
Garnier et al.

(10) Patent No.: US 6,945,076 B1
(45) Date of Patent: Sep. 20, 2005

(54) PRODUCTION UNIT FOR LARGE QUANTITIES OF OXYGEN AND/OR NITROGEN

(75) Inventors: Emmanuel Garnier, Paris (FR); Jean-Pierre Gourbier, Le Plessis Trevise (FR); Lasad Jaouani, Bobigny (FR); Frédéric Judas, Chatenay Malabry (FR); Giovanni Massimo, Belgium (BE)

(73) Assignee: L'Air Liquide, Societe Anonyme pour l'etude et, l'Exploitation des Procedes Georges Claude, Paris (FR)

( * ) Notice: Subject to any disclaimer, the term of this patent is extended or adjusted under 35 U.S.C. 154(b) by 0 days.

(21) Appl. No.: 10/661,929

(22) Filed: Sep. 11, 2003

(30) Foreign Application Priority Data

Sep. 11, 2002 (FR) ..... 02 11232

(51) Int. Cl.[7] ..... F25J 3/00; F25J 5/00
(52) U.S. Cl. ..... 62/643; 62/902; 62/911
(58) Field of Search ..... 62/643, 644, 648, 62/902, 911

(56) References Cited

U.S. PATENT DOCUMENTS 1,974,065 A * 9/1934 Mathias ..... 62/643
2,084,987 A * 6/1937 Borchardt et al. ..... 62/656
2,105,214 A * 1/1938 De Baufre ..... 62/645
4,608,818 A * 9/1986 Goebel et al. ..... 60/39.12
5,123,249 A * 6/1992 Buttle ..... 62/646
5,461,871 A * 10/1995 Bracque et al. ..... 62/643
5,806,341 A * 9/1998 Rathbone ..... 62/646
5,896,755 A * 4/1999 Wong et al. ..... 62/643
6,128,921 A 10/2000 Guillard et al.
6,148,637 A * 11/2000 Guillard et al. ..... 62/643
6,185,960 B1 * 2/2001 Voit ..... 62/656
6,272,883 B2 * 8/2001 Bruder et al. ..... 62/643

FOREIGN PATENT DOCUMENTS

EP 1160528 A2 12/2001
WO WO03016804 A2 2/2003

OTHER PUBLICATIONS

French Search Report to FR 02 11232.
"Process and Facility With Particularly High Availability," Research Disclosure, Kenneth Mason Publications, Hampshire, GB, No. 397, May 1, 1997, pp. 276-279, XP000726402; ISSN: 0374-4353.

* cited by examiner

*Primary Examiner*—William C. Doerrler
(74) *Attorney, Agent, or Firm*—Linda K. Russell

(57) ABSTRACT

An apparatus and method for air distillation. Two cold boxes and an air treatment unit are used to distill air. The cold boxes contain a heat exchanger for cooling the air to be distilled and an air distillation unit for producing either oxygen, nitrogen or argon. The air treatment unit has many individual treatment elements which are connected in parallel. The outlet of the air treatment unit is connected to both cold boxes and to all the individual treatment units.

30 Claims, 3 Drawing Sheets

PRODUCTION UNIT FOR LARGE QUANTITIES OF OXYGEN AND/OR NITROGEN

This application claims the benefit of priority under 35 U.S.C. § 119 (a) and (b) 1 to French Application No. 0211232 filed Sep. 11, 2002, the entire contents of which are incorporated herein by reference.

BACKGROUND

The pressures mentioned here are absolute pressures.

Industrial synthetic hydrocarbon production units called GTL (Gas-To-Liquid) units may have a production capacity of around 50 000 barrels per day, which corresponds to a consumption of about 12 000 metric tons of oxygen per day.

To produce such quantities of oxygen, it is necessary to provide several, typically three or four, air distillation units in parallel. In addition, to bring the oxygen to the high pressure needed for operating the GTL unit, it is advantageous for the liquid oxygen produced by distillation to be pumped to this high pressure and for the liquid to be vaporized by heat exchange with a heat transfer fluid compressed to a pressure high enough to allow oxygen to vaporize, this heat transfer fluid typically being pressurized air. Thus, the use of gaseous oxygen compressors, which is always tricky, is avoided.

Such plants are described in "*Oxygen Facilities for Synthetic Fuel Projects*" by W. J. Scharle et al., Journal of Engineering for Industry, November 1981, Vol. 103, pp. 409–411.

SUMMARY

The present invention relates to a plant for producing oxygen and/or nitrogen and/or argon by air distillation. The invention applies, for example, to the production of large quantities of high-pressure oxygen, especially for feeding synthetic hydrocarbon production units.

The object of the invention is to reduce the investment, optionally by maximizing the size of the equipment item, and to benefit from a synergy for back-up systems, which will allow the reliability of these plants to be increased.

For this purpose, the subject of the invention is a plant for producing oxygen and/or nitrogen and/or argon by air distillation, comprising: N(N>1) cold boxes, each of which comprises, on the one hand, a heat exchange line for cooling the air to be distilled and, on the other hand, an air distillation apparatus that produces oxygen and/or nitrogen and/or argon; and means for treating the air that feeds the air distillation apparatuses and optionally means for treating a fluid coming from the air distillation apparatuses, these air treatment means or the fluid treatment means comprising several items of equipment mounted in parallel and networked with their inlets and/or their outlets connected to a common header that collects or redistributes all of the air or of the fluid from the corresponding treatment step and, if the fluid treatment means have several items of equipment mounted in parallel and networked, these treatment means being turbines and/or pumps and/or heaters and/or cooling towers.

These treatment means are preferably placed downstream of the main air compressors that are used to compress the air starting from the ambient pressure.

Preferably, the treatment means treat air intended for all the distillation apparatuses or treat a fluid coming from all the distillation apparatuses.

The plant according to the invention may include one or more of the following features:

- the air treatment means comprising several items of equipment mounted in parallel and networked are the first atmospheric air compression means and/or the second air precooling means and/or third means for purifying the precooled air by adsorption and/or expansion turbines and/or boosters;
- the turbines of claim 1 may be nitrogen turbines and the pumps may be nitrogen, oxygen or argon pumps;
- the first, second and third (11) treatment means comprise N1, N2, N3 items of equipment respectively and wherein at least one of the numbers N1, N2, N3 is different from N, the corresponding apparatuses being mounted in parallel with their outlets connected to a common header;
- N2>2 and wherein the second means comprise at least one common coolant production device;
- said common device is a water/nitrogen cooling tower that includes an inlet header connected to a waste nitrogen outlet of the N cold boxes;
- N3>2 and wherein the third means comprise at least one common heater for an adsorbent regeneration gas;
- the common heater includes an inlet header connected to a waste nitrogen outlet of the N cold boxes;
- the treatment means furthermore comprise N4 secondary gas compressor, air boosters in particular mounted in parallel with their inlets and their outlets connected to common headers, N4 optionally being different from N, preferably greater than N;
- N4=N1, each main air compressor/air booster pair having a common drive member;
- each cold box produces liquid oxygen and/or liquid nitrogen and/or organ and wherein the plant comprises N6 liquid oxygen and/or liquid nitrogen and/or liquid argon pumps mounted in parallel between an inlet header and a common outlet header that are connected to the N air distillation apparatuses and to the N heat exchange lines respectively, N6 optionally being different from N, preferably greater than N;
- the treatment means furthermore include N5 turbines mounted in parallel between common inlet headers and common outlet headers, N5 optionally being different from N, preferably greater than N;
- N7 final oxygen gas compressors mounted in parallel between an input header and an output header, N7 optionally being different from N, preferably greater than N;
- N8 compressors for the nitrogen gas produced, these being mounted in parallel between an input header and an output header, N8 optionally being different from N, preferably greater than N;
- at least some of said items of equipment in parallel and networked are N+1 in number, each of these items of equipment having the capacity to feed one of the N air distillation apparatuses or the capacity to treat fluid for one of the N air distillation apparatuses;
- at least some of said items of equipment in parallel and networked are N+n1 in number (n1>1), each of these items of equipment having a lesser capacity than that needed to feed a distillation apparatus or to treat a fluid of a distillation apparatus;
- at least some of said items of equipment in parallel and networked are N−n2 in number (n2>1), each of these items of equipment having a greater capacity than that needed to feed a distillation apparatus (4) or to treat fluid of a distillation apparatus (4).

BRIEF DESCRIPTION OF THE DRAWINGS

For a further understanding of the nature and objects for the present invention, reference should be made to the following detailed description, taken in conjunction with the accompanying drawings, in which like elements are given the same or analogous reference numbers and wherein.

DESCRIPTION OF PREFERRED EMBODIMENTS

Figure 1:
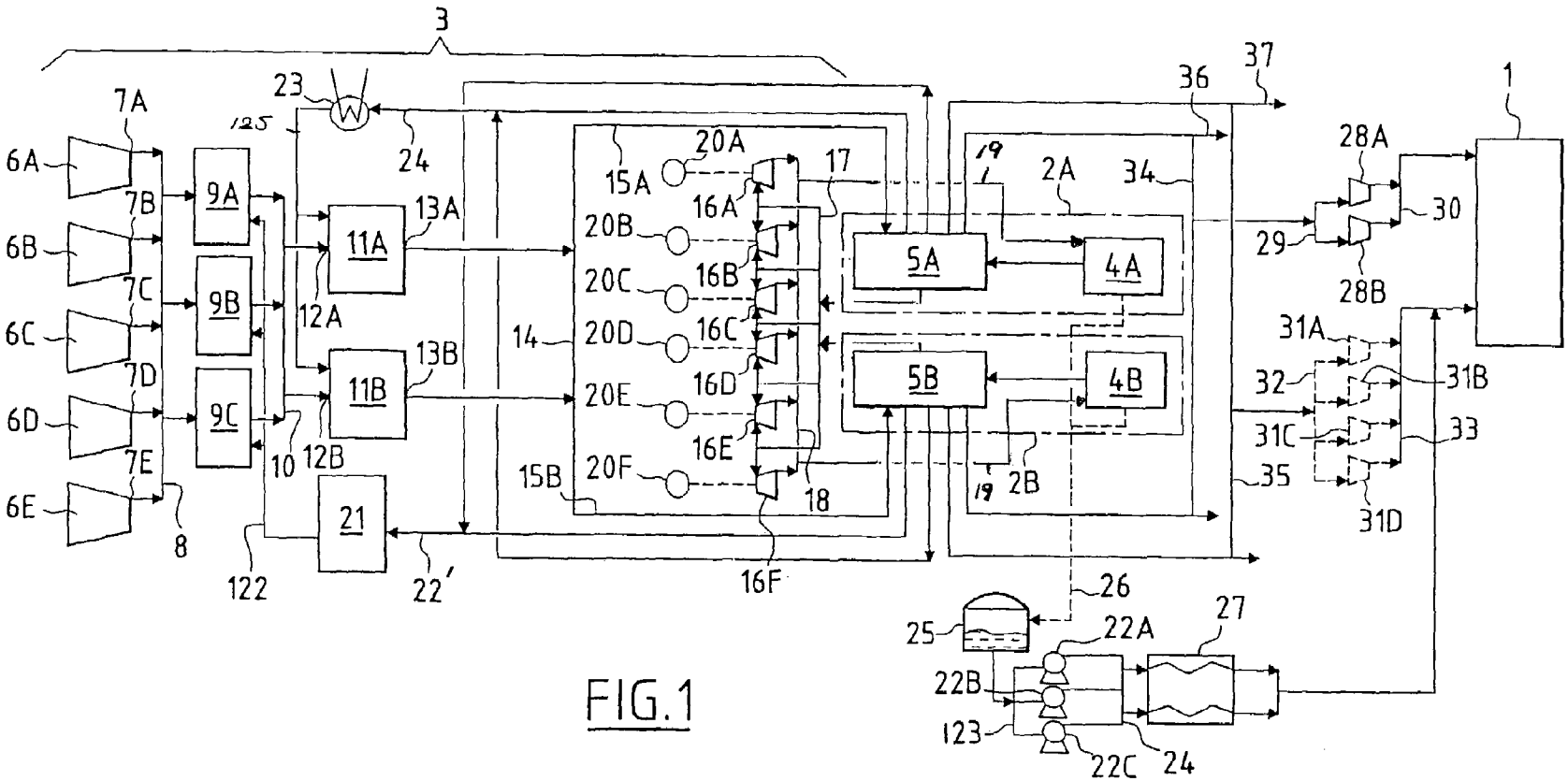
FIG. 1 illustrates schematically, one embodiment according to the current invention.

The plant shown in FIG. 1 is designed to feed high-pressure oxygen to one or more GTL units 1. The high production pressure is typically between 30 and 65 bar.

The plant comprises two identical cold boxes 2A and 2B mounted in parallel and means 3 for treating the air to be distilled downstream of the main compressor 6.

In what follows, when several identical apparatuses are involved, they will be denoted either by a number followed by the suffix A, B, . . . , or by the general reference consisting of just the number.

As shown schematically in the case of the cold box 2A, each cold box essentially comprises an air distillation apparatus 4, for example a double distillation column, that produces gaseous oxygen GO, gaseous nitrogen GN and a waste gas (impure nitrogen) W, and optionally argon, and a main heat exchange line 5A, 5B that cools the air to be distilled countercurrently with the streams coming from the associated distillation apparatus.

The treatment means 3 upstream of the cold box 2 comprise, in succession from the upstream end to the downstream end:

- five main air compressors 6, all identical. These compressors are mounted in parallel and networked at their outlet, that is to say their outlets 7 run into a common header 8. They compress the atmospheric air to the medium distillation pressure of the apparatuses 4;
- three compressed-air precoolers 9, all identical, refrigerated by water in a manner described later. The header 8 is connected to the inlet of the three precoolers 9. The apparatuses 9 are thus mounted in parallel and networked at their inlet. They are also mounted in parallel and networked at their outlet, by means of a header 10; and
- two identical purification apparatuses 11, for purifying air of water and of $CO_2$ by adsorption. Each of these apparatuses comprises two bottles in parallel, containing a suitable absorbent, such as a molecular sieve, and has its air inlet 12 connected to the header 10. The purified air outlets 13 of the apparatuses 11 run into a common header 14. The apparatuses 11 are thus mounted in parallel and networked at their inlet and at their outlet.

Starting from the header 14 are two pipes 15 that terminate respectively at a medium-pressure air inlet of each heat exchange line 5.

The treatment means 3 furthermore include six air expansion turbines 16, all identical, that serve to keep the plant cold. The turbines 16 have their inlets connected to a header 17 for the medium-pressure air cooled in the exchange lines 5 and their outlets are connected to another common header 18. The turbines 16 are placed inside an insulated enclosure that contains only these turbines as air treatment means.

These six turbines are thus mounted in parallel and networked, both at their inlet and at their outlet. Leaving the header 18 are two pipes 19 that terminate respectively at a low-pressure air inlet of each heat exchange line 5, the cooled low-pressure air being blown into the low-pressure column of each apparatus 4, optionally after a subcooling step. Each turbine is braked by a brake or an alternator 20 that is placed outside the insulated enclosure.

Of course, the pipes 19 may terminate at a medium-pressure air inlet if the air delivered to the turbines 16 is at a higher pressure than the medium pressure.

Likewise, the header 17 may be connected to an inlet for medium-pressure nitrogen coming from the apparatus 4 and the expanded nitrogen may, on passing through the header 18, be vented to atmosphere.

The treatment means 3 also include:

- at least one common cooling tower 21 for cooling the water intended for the three precoolers 9 with the waste nitrogen. This tower is fed with waste nitrogen via a header 22' connected to a waste outlet of the two exchange lines 5 and produces refrigerated water in a header 122 connected to the two precoolers; and
- at least one common heater 23 for heating the waste nitrogen used to regenerate the adsorbent of the apparatuses 9. This waste nitrogen comes from a header 24 connected to another waste outlet of the two exchange lines 5. The at least one common heater is connected to a header 125.

Because of the presence of the headers 8 for the wet compressed air, the header 10 for the precooled compressed air, the header 14 for the purified air, the header 17 for the medium-pressure air cooled at the inlet of the expansion turbines 16 and the header 18 for the expanded air, which headers network all the flows of these fluids, failure of one item of equipment may be easily compensated for by the other items of equipment of the same type.

Networking the items of equipment also makes it possible to decouple the number of apparatuses in parallel from the number N (here N=2) of cold boxes and also to decouple the number of successive apparatuses in parallel, provided that the treatment capacities of the apparatuses in question are chosen appropriately. It is thus possible to optimize the size of each item of equipment.

In particular, the use of (N+1) items of equipment in parallel and networked (which is the case with the precoolers 9) makes it possible to benefit from one emergency item of equipment for the N others, each of which has the capacity corresponding to a cold box 2.

In the plant shown in FIG. 1, other items of equipment, located downstream of the previous ones, are also mounted in parallel and networked, at their inlet and at their outlet:

- three emergency vaporization pumps 22 mounted in parallel between a suction header 123 and a delivery header 24. The header 123 is connected to a tank 25 for storing the liquid oxygen or liquid nitrogen produced by the apparatuses 4A and 4B, said tank being fed via a header 26. Should there be insufficient delivery to the unit 1 of the corresponding gas, the flow needed is taken off, at the same pressure, from the header 24 and vaporized in an emergency air or water exchanger 27;
- two final nitrogen compressors 28 mounted in parallel between a suction header 29 and a delivery header 30. These compressors bring the gaseous nitrogen to the high feed pressure for the unit 1; and optionally, four final oxygen compressors 31 mounted in parallel between a suction header 32 and a delivery header 33. These compressors bring the gaseous oxygen to the high feed pressure for the unit 1.

As shown, each header 29, 32 is connected to a respective header 34, 35 that collects the corresponding gas heated by the heat exchange lines 5A and 5B. If necessary, a flow of each gas may be taken off from these headers, as illustrated at 36, 37.

Figure 2:
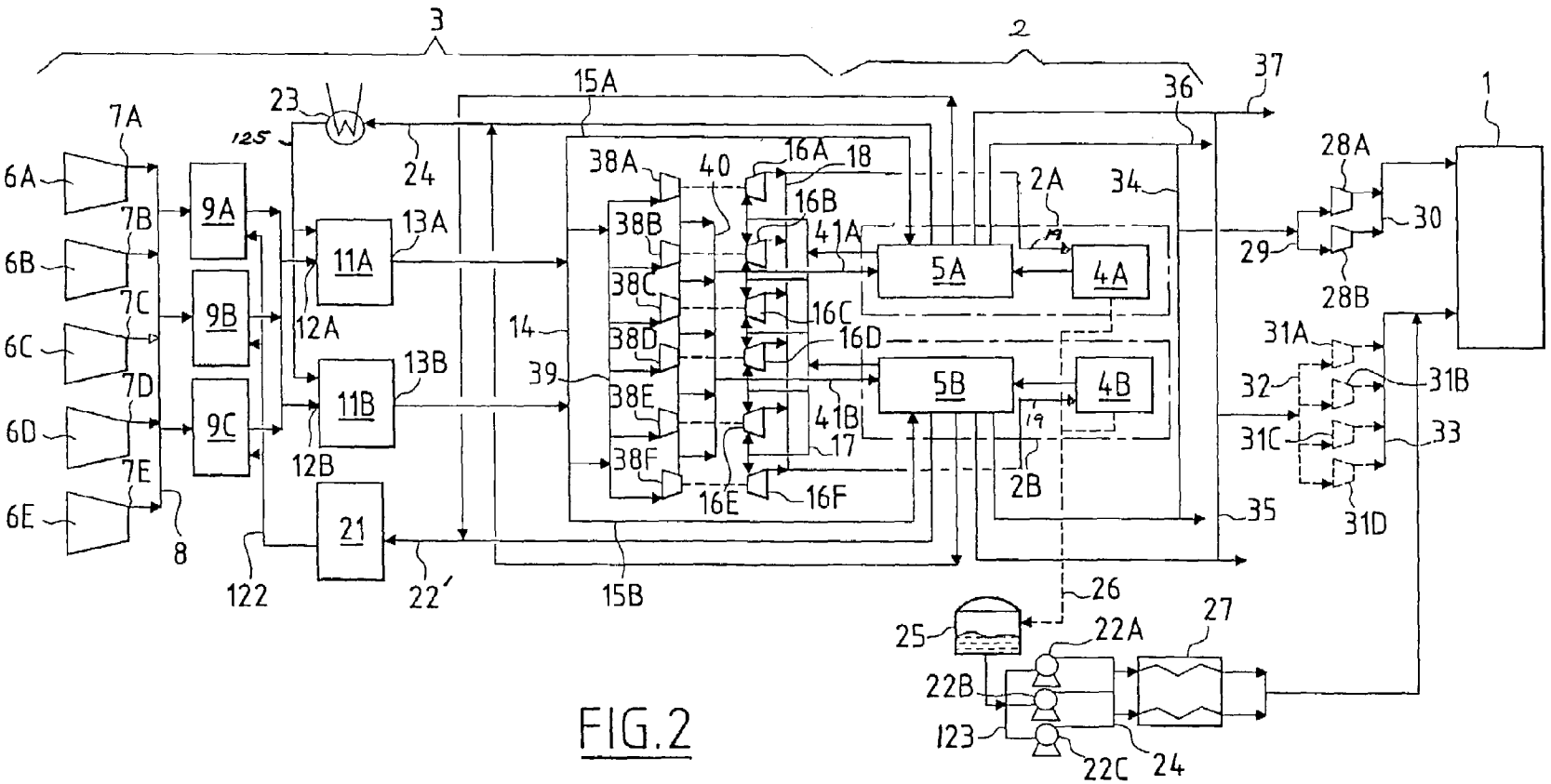
FIG. 2 illustrates schematically, another embodiment according to the current invention.

The alternative embodiment shown in FIG. 2 differs from the previous one by the brakes 20 of the turbines 16 being replaced with as many boosters 38. Each of these boosters is fastened to the shaft of the corresponding turbine. The boosters are mounted in parallel between an inlet header 39 and an outlet header 40; the latter is connected to the header 17 via two partial cooling circuits 41 passing through the exchange lines 5A and 5B.

The turbines 16 will once again be located in an insulated enclosure.

Figure 3:
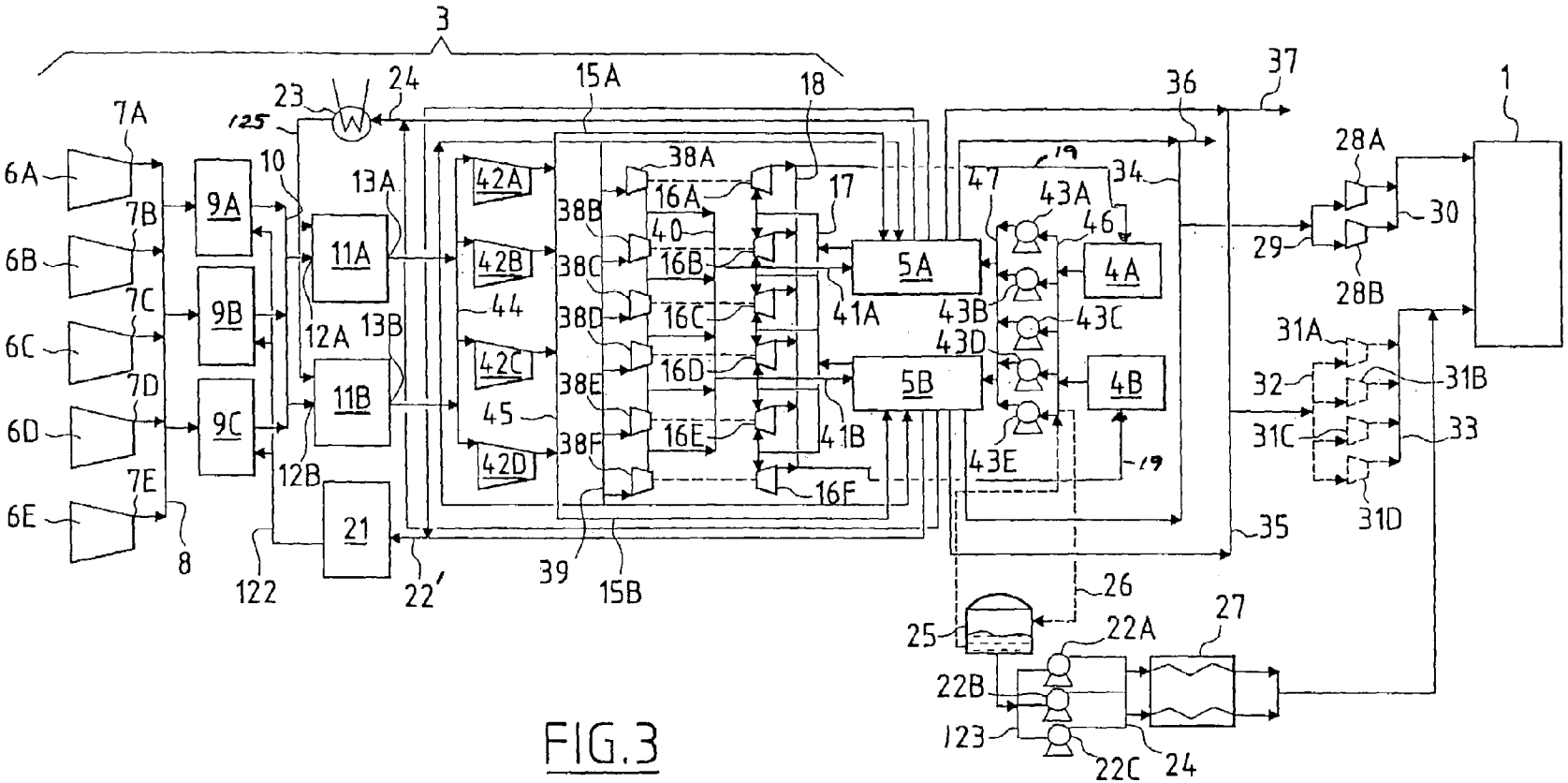
FIG. 3 illustrates schematically, a third embodiment according to the current invention.

The plant shown in FIG. 3 differs from the previous one by the addition of four secondary air compressors 42, that treat a fraction of the incoming air flow, and five liquid oxygen pumps 43. The compressors 42 are mounted in parallel between a suction header 44 connected to the header 14 and a delivery header 45 connected to high-pressure air inlets of the exchange lines 5A and 5B. The pumps 43 are mounted in parallel between a suction header 46, which receives the low-pressure liquid oxygen coming from the apparatuses 4, and a cooling header 47 connected to pressurized liquid oxygen inlets of the exchange lines 5. This oxygen is vaporized by heat exchange with the high-pressure air.

In this case, the tank 25 is optionally a buffer tank for the pumps 43.

As a variant, the number of compressors 42 may be equal to the number of compressors 6, each pair of compressors 6-42 having a common shaft and a common drive member.

Because of the presence of the headers 44, 45 that allow all of the air at the inlet and at the outlet of the boosters 42 to be networked, failure of one item of equipment may be easily compensated for by the other items of equipment.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

What is claimed is:

1. An apparatus which may be used for air distillation, said apparatus comprising:

a) at least two cold boxes, wherein said cold boxes comprise:
   1) at least one heat exchanger, wherein said heat exchanger comprises a cooling means for cooling the air to be distilled; and
   2) at least one air distillation unit, wherein said distillation unit comprises a production means for producing at least one member selected from the group consisting of:
      i) oxygen;
      ii) nitrogen; and
      iii) argon; and b) an air treatment unit, wherein said air treatment unit comprises:
   1) an air treatment means for treating air to be sent to said distillation units, wherein said air treatment means comprises a plurality of air treatment elements connected in parallel; and
   2) an outlet, wherein said outlet is connected to both said cold boxes and to all of said air treatment elements connected in parallel.

2. The apparatus of claim 1, further comprising a fluid treatment unit, wherein:

a) said fluid treatment unit comprises:
   1) a fluid treatment means for treating a fluid produced by said distillation units, wherein said fluid treatment means comprises a plurality of fluid treatment elements connected in parallel; and
   2) an inlet, wherein said inlet is connected to both said cold boxes and to all of said fluid treatment elements connected in parallel; and b) said fluid treatment elements comprise at least one member selected from the group consisting of:
   1) a turbine;
   2) a pumping means;
   3) a heating means; and
   4) a cooling tower.

3. The apparatus of claim 2, wherein said air treatment elements comprise at least one member selected from the group consisting of:

a) an air compression means;
b) an air precooler means;
c) an adsorber type purifying means;
d) an expansion turbine; and
e) an air booster.

4. The apparatus of claim 3, wherein:

a) the number of said cold boxes in said apparatus is different from the number of said air treatment elements; and
b) said air treatment elements comprise at least one member selected from the group consisting of:
   1) an air compression means;
   2) said air precooler means; and
   3) said adsorber type purifying means.

5. The apparatus of claim 4, wherein said air treatment element comprises said precooler means, which further comprises:

a) at least two individual precooler units; and
b) at least one common coolant production means.

6. The apparatus of claim 5, wherein:

a) said coolant production means comprises a water/nitrogen cooling tower; and
b) said tower comprises:
   1) a tower inlet header connected to a waste nitrogen outlet of said cold box; and
   2) a tower outlet header.

7. The apparatus of claim 3, wherein said air treatment element comprises said adsorber type purifying means comprising:

a) at least two individual purifying units; and
b) at least one common heater means for an adsorbent regeneration gas.

8. The apparatus of claim 7, wherein said common heater means comprises:

a) an inlet header connected to a waste nitrogen out let of said cold box; and
b) an outlet header.

9. The apparatus of claim 1, wherein said air treatment unit further comprises at least two air boosters, wherein:

a) said air boosters are mounted in parallel; and
b) said air boosters comprise:

1) an air booster inlet connected to a common header; and
2) an air booster outlet connected to said common header.

10. The apparatus of claim 9, wherein the number of said air boosters is different from the number of cold boxes.

11. The apparatus of claim 9, wherein:
a) the number of said air compressors equals the number of said air boosters; and
b) said boosters and said compressors operate in booster-compressor pairs by sharing a common drive member.

12. The apparatus of claim 1, wherein each said cold box comprises a production means to produce at least one member selected from the group consisting of:
a) liquid oxygen;
b) liquid nitrogen; and
c) liquid argon.

13. The apparatus of claim 12, wherein:
a) said apparatus further comprises at least two pumps mounted in parallel between a pump inlet header and a pump outlet header;
b) said pump inlet header is connected to said air distillation unit; and
c) said pump outlet header is connected to said heat exchanger.

14. The apparatus of claim 13, wherein the number of said pumps is different than the number of cold boxes.

15. The apparatus of claim 1, wherein:
a) said air treatment unit further comprises at least two turbines; and
b) said turbines are mounted in parallel between a turbine inlet header and a turbine outlet header.

16. The apparatus of claim 15, wherein the number of turbines is different from the number of cold boxes.

17. The apparatus according to claim 3, wherein:
a) the total number of said air treatment elements and said fluid treatment elements is at least one greater than the number of said cold boxes;
b) each said air treatment element has about the capacity needed to supply one of said air distillation units; and
c) each said fluid treatment element has about the capacity needed to treat said fluid for said air distillation unit.

18. The apparatus of claim 3, wherein:
a) the total number of said air treatment elements and said fluid treatment elements is at least two greater than the total number of said cold boxes;
b) each said air treatment element has a capacity greater than needed to supply one of said air distillation units; and
c) each said fluid treatment element has a capacity greater than needed to treat fluid for said air distillation unit.

19. An apparatus which may be used for producing at least one of oxygen, nitrogen, and argon by distillation of air comprising at least two cold boxes, each cold box comprising a heat exchanging line for an air and an air distillation unit producing at least one of oxygen, nitrogen and argon, a treatment unit for treating air to be sent to at least two of the air distillation units using a number of identical elements connected in parallel, said treatment unit having an outlet connected to at least two of the cold boxes and to all of the elements connected in parallel.

20. An apparatus for producing at least one of oxygen, nitrogen, and argon by distillation of air comprising at least two cold boxes, each cold box comprising a heat exchanging line for the air and an air distillation unit producing at least one of oxygen, nitrogen and argon, a treatment unit for treating a fluid produced by at least two of the air distillation units using a number of identical elements connected in parallel, said treatment unit having an inlet connected to at least two of the cold boxes and to all of the elements connected in parallel and the elements of the treatment unit being selected from the group comprising:
a) turbines;
b) pumps;
c) heaters; and
d) cooling towers.

21. A method which may be used for the distillation of air, said method comprising:
a) treating air in an air treatment unit, wherein said air treatment unit comprises a plurality of air treatment elements connected in parallel;
b) sending said treated air to at least two cold boxes, wherein said cold box comprises:
1) at least one heat exchanger; and
2) at least one air distillation unit, wherein said air distillation unit produces at least one member selected from the group consisting of:
i) oxygen;
ii) nitrogen; and
iii) argon.

22. The method of claim 21, further comprising treating a fluid from said air distillation unit with a fluid treatment unit, wherein:
a) said fluid treatment unit comprises:
1) a means for treating a fluid produced by said distillation units, wherein said means comprises a plurality of fluid treatment elements connected in parallel; and
2) an inlet, wherein said inlet is connected to both said cold boxes and to all of said fluid treatment elements connected in parallel; and
b) said fluid treatment elements comprise at least one member selected from the group consisting of:
1) turbines;
2) pumps;
3) heaters; and
4) cooling towers.

23. The method of claim 21, wherein said air treatment elements comprise at least one member selected from the group consisting of:
a) an air compression means;
b) an air precooler means;
c) an adsorber type purifying means;
d) an expansion turbine; and
e) an air booster.

24. The method of claim 23, further comprising precooling with a precooler means comprising:
a) at least two units; and
b) at least one common coolant production device.

25. The method of claim 23, further comprising purifying with a adsorber type purifier means comprising:
a) at least 2 units; and
b) at least one common heater for an adsorbent regeneration gas.

26. The method of claim 21, further comprising producing a liquid product with said cold box, wherein said liquid product comprises at least one member selected from the group consisting of:
a) liquid oxygen;
b) liquid nitrogen; and
c) liquid argon.

27. The method of claim 21, further comprising distilling said air, wherein:

a) the total number of said air treatment elements and said fluid treatment elements is at least one greater than the number of said cold boxes;

b) each said air treatment element has about the capacity needed to supply one of said air distillation units; and c) each said fluid treatment element has about the capacity needed to treat said fluid for said air distillation unit.

28. The method of claim 21, further comprising distilling said air, wherein:

a) the total number of said air treatment elements and said fluid treatment elements is at least two greater than the total number of said cold boxes;

b) each said air treatment element has a capacity greater than needed to supply one of said air distillation units; and c) each said fluid treatment element has a capacity greater than needed to treat fluid for said air distillation unit.

29. A method for producing at least one of oxygen, nitrogen, and argon by distillation of air comprising at least two cold boxes, each cold box comprising a heat exchanging line and an air distillation unit producing at least one of oxygen, nitrogen, and argon, and a treatment unit wherein air to be sent to at least two of the air distillation units is treated in the treatment unit using a number of identical elements connected in parallel to produce treated air, and said treated air is sent to at least two of the cold boxes.

30. A method for producing at least one of oxygen, nitrogen, and argon by distillation of air comprising at least two cold boxes, each cold box comprising a heat exchange line and an air distillation unit producing at least one of oxygen, nitrogen, and argon and a treatment unit for treating a fluid produced by at least two of the air distillation units using an identical number of elements connected in parallel, wherein a fluid produced by at least two of the air distillation units is sent to the treatment unit and removed as a treated fluid, wherein the treated fluid is treated by a process comprising turbine expansion, pumping, heating and cooling.

* * * * *